US008674886B2

(12) United States Patent
Ohno et al.

(10) Patent No.: US 8,674,886 B2
(45) Date of Patent: Mar. 18, 2014

(54) MOBILE TERMINAL

(75) Inventors: Junichi Ohno, Saitama (JP); Aiko Yoshida, Kanagawa (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 313 days.

(21) Appl. No.: 13/213,219

(22) Filed: Aug. 19, 2011

(65) Prior Publication Data

US 2012/0162025 A1 Jun. 28, 2012

Related U.S. Application Data

(60) Provisional application No. 61/426,711, filed on Dec. 23, 2010.

(51) Int. Cl.
*H01Q 1/24* (2006.01)

(52) U.S. Cl.
USPC ..... 343/702

(58) Field of Classification Search
USPC ..... 343/702, 700 MS, 876, 756; 455/575.3
See application file for complete search history.

(56) References Cited

U.S. PATENT DOCUMENTS

| | | | | |
|---|---|---|---|---|
| 6,239,744 | B1 * | 5/2001 | Singer et al. | 342/359 |
| 7,173,570 | B1 * | 2/2007 | Wensink et al. | 343/760 |
| 7,212,164 | B2 * | 5/2007 | Miyano et al. | 343/702 |
| 7,969,381 | B2 * | 6/2011 | Kanazawa et al. | 343/876 |
| 2006/0181476 | A1 | 8/2006 | Watanabe | |
| 2006/0187125 | A1 | 8/2006 | Watanabe | |
| 2006/0187138 | A1 | 8/2006 | Watanabe | |
| 2006/0276221 | A1 | 12/2006 | Lagnado et al. | |
| 2006/0290582 | A1 * | 12/2006 | Lee | 343/745 |
| 2009/0109118 | A1 | 4/2009 | Ma et al. | |
| 2009/0189824 | A1 | 7/2009 | Nishikido et al. | |

FOREIGN PATENT DOCUMENTS

| | | |
|---|---|---|
| CN | 2899147 Y | 5/2007 |
| EP | 1 841 006 A1 | 10/2007 |
| JP | 2010-109522 | 5/2010 |
| JP | 2010-0258490 | 11/2010 |

OTHER PUBLICATIONS

Extended European Search Report issued Apr. 4, 2012, in Patent Application No. 11179855.9.
Chinese Office Action issued Dec. 23, 2013 in Chinese Application No. 201110356458.7 with English translation, 11 pages.

* cited by examiner

*Primary Examiner* — Huedung Mancuso
(74) *Attorney, Agent, or Firm* — Oblon, Spivak, McClelland, Maier & Neustadt, L.L.P.

(57) ABSTRACT

A mobile terminal including an antenna device including an antenna element and a first non-feeding element, a radio-frequency unit that receives a signal from the antenna element, first and second matching circuits connected to the antenna element, a first switch that selectively connects one of the first and second matching circuits to the radio-frequency unit, a second switch that selectively grounds the first non-feeding element, an attitude-detection unit that detects an attitude of the mobile terminal, and a control unit that controls the first and second switches based on an output of the attitude-detection unit.

20 Claims, 20 Drawing Sheets

MOBILE TERMINAL

CROSS REFERENCE TO RELATED APPLICATION

The present application claims the benefit of the earlier filing date of U.S. Provisional Patent Application Ser. No. 61/426,711 filed on Dec. 23, 2010, the entire contents of which is incorporated herein by reference.

BACKGROUND OF THE DISCLOSURE

1. Field of the Disclosure

The present disclosure relates to an antenna device including an antenna element having a directivity toward a fixed direction.

2. Description of Related Art

In recent years, a mobile terminal typified by a mobile phone has become multifunctional and sophisticated, and the GPS (Global Positioning System) function has been installed in many mobile terminals. The GPS function allows for receiving radio waves that are transmitted from a plurality of GPS satellites and obtaining the current position of the terminal based on the reception signals.

On the earth's surface where the mobile terminal is used, the radio waves that are transmitted from the GPS satellites come from the sky. Therefore, the directivity of a GPS antenna provided in the mobile terminal needs to be aimed at the sky to increase the GPS-signal reception intensity.

However, there has been a growth in the opportunity to use the GPS function in the horizontal-holding state, such as viewing a map on an image screen, and the directivity attained at that time has also become important. That is, since the mobile terminal is used not only in the vertical-holding state where the mobile terminal is held so that the length direction thereof agrees with an up/down direction (an almost vertical direction), but also in the horizontal-holding state where the mobile terminal is held so that the length direction of the mobile terminal agrees with a horizontal direction, it is preferred that the directivity of the GPS antenna point in the zenith direction in either state.

According to known technologies, a mobile terminal including two GPS antennas and an acceleration sensor has been proposed as disclosed in Japanese Unexamined Patent Application Publication No. 2010-109522. In the mobile terminal, the inclination of the cabinet is sensed and a binary signal is output to operate a changeover switch making a changeover between the two GPS antennas, and the directivity of the GPS antenna, the directivity being aimed at the sky in the two states corresponding to vertical holding and horizontal holding by the changeover, becomes a reality.

SUMMARY

The technology described in Japanese Unexamined Patent Application Publication No. 2010-109522 allows for changing the directivities of the GPS antennas so that the directivities are aimed at the sky in the vertical-holding state and the horizontal-holding state of the mobile terminal. However, there is a problem that the use of the two GPS antennas requires respective antenna spaces and the mobile terminal is increased in size.

In a mobile terminal including an antenna device having a directivity toward a fixed direction, the present disclosure is used to achieve making it possible to aim the directivity in a target direction irrespective of the attitude thereof with a relatively simple configuration and without increasing the installation space.

A mobile terminal according to the present disclosure includes an antenna device including an antenna element and a first non-feeding element, a radio-frequency unit that receives a signal from the antenna element, first and second matching circuits connected to the antenna element, a first switch that selectively connects one of the first and second matching circuits to the radio-frequency unit, a second switch that selectively grounds the first non-feeding element, an attitude-detection unit that detects an attitude of the mobile terminal, and a control unit that controls the first and second switches based on an output of the attitude-detection unit.

The target direction is the direction of the sky, and the attitude is either of a vertical state and a horizontal state, for example.

The attitude of the mobile terminal, that is, the vertical state and the horizontal state can be detected with the attitude-detection unit. For example, it becomes possible to rotate the directivity obtained in the vertical state about 90 degrees and aim the directivity in the target direction (e.g., the sky) by grounding the non-feeding element with the second switch based on an output of the detection of the horizontal state, for example. Further, by making a changeover between the first and second matching circuits that are connected to the antenna element with the first switch, a shift of the resonance frequency of the antenna element, which occurs due to the grounded non-feeding element, is compensated.

Preferably, the grounding spot of the non-feeding element is set so that the grounding spot of the non-feeding element is on the earth's surface side in the horizontal state.

Further, a second non-feeding element of which grounding spot is different from the non-feeding element (a first non-feeding element) in a direction of a width of the mobile terminal, and a third switch configured to selectively ground the second non-feeding element to the grounding spot may be provided. In that case, the control unit controls a changeover between the first, second, and third switches based on an output of the attitude-detection unit. Accordingly, when the target direction is a direction of the sky, the attitude can be ready for three states including a vertical state, a first horizontal state, and a second horizontal state (a state achieved by rotating the first horizontal state 180 degrees while determining an axis perpendicular to the main face of a cabinet to be a center) opposite thereto.

Preferably, the grounding spot of the first non-feeding element is on the earth's surface side in the first horizontal state, and the grounding spot of the second non-feeding element is on the earth's surface side in the second horizontal state.

When the feeding element is arranged inside the cabinet as an antenna unit, the non-feeding element may be provided on a back face of a cabinet cover opposed to the antenna unit as a conductive pattern.

The antenna device may include another non-feeding element that is arranged near the feeding element and that improves a directivity of the feeding element.

The present disclosure allows for aiming the directivity of an antenna device in a target direction based on the attitude of a mobile terminal by using a non-feeding element which is selectively grounded to a grounding spot based on the attitude of the mobile terminal. Further, according to a configuration provided therefor, the antenna space does not become larger than in the case where a plurality of known antenna devices is used.

By responding to a GPS antenna with an antenna device of the present disclosure, a user can aim the directivity of the GPS antenna at the sky in either of a vertical state and a horizontal state with a mobile terminal of current size. As a consequence, it becomes possible to keep a favorable sensitivity of reception of a GPS satellite-radio wave and enjoy the GPS function under no stress.

DESCRIPTION OF THE PREFERRED EMBODIMENTS

Hereinafter, preferred embodiments of the present disclosure will be described in detail with reference to drawings.

Figure 1:
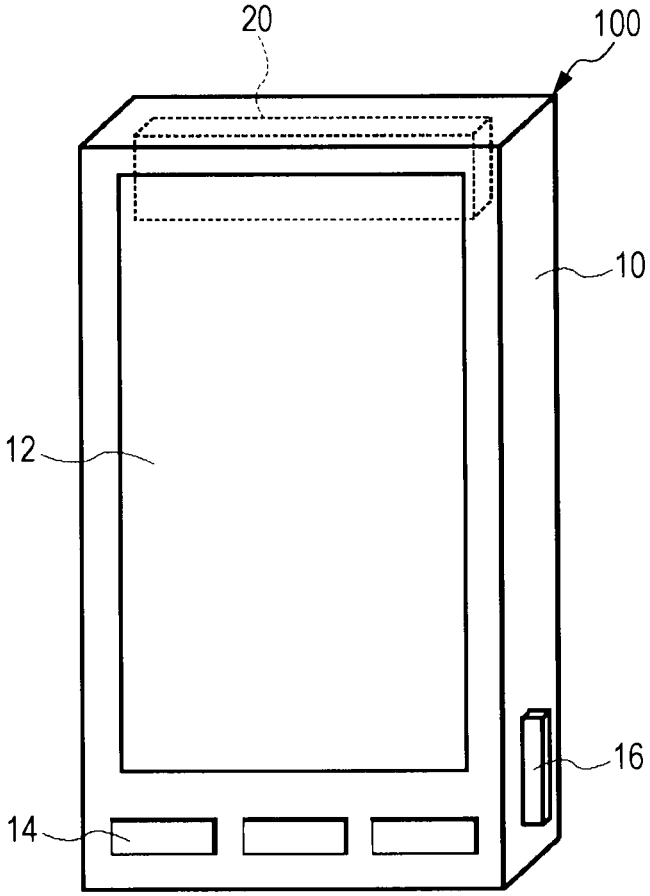
FIG. 1 shows an exemplary external view of a mobile terminal to which the present disclosure is applied.

FIG. 1 shows an exemplary external view of a mobile terminal 100 to which the present disclosure is applied. The mobile terminal 100 includes a cabinet 10 shaped almost like a rectangular parallelepiped. A display unit 12 having a display image screen which also serves as a touch panel is provided on almost the entire area of the front face of the cabinet 10 (the main plane of the cabinet), and three adjacent operation keys 14 are provided thereunder. In this example, the display unit 12 includes a liquid crystal display device (LCD). A shutter button 16 of a camera is provided on the right side face of the cabinet 10. A GPS antenna 20 which is an antenna device according to the present embodiment is provided in the upper end of the cabinet 10 of the mobile terminal 100.

The mobile terminal 100 shown in FIG. 1 indicates a termination configuration referred to as a so-called smartphone. However, a termination configuration to which the present disclosure is applied is not limited to the shown configuration. For example, a termination configuration including reclosably coupled upper and lower cabinets may be provided. Further, the above-described termination configuration may be any of a so-called bivalved folding type, a vertical sliding type provided so that a lower cabinet hidden behind an upper cabinet slides along the direction of the length of the terminal and a numeric keypad appears, a horizontal sliding type provided so that a lower cabinet hidden behind an upper cabinet slides along a direction orthogonal to the terminal length direction and a so-called full keyboard (which may not include the numeric keypad) appears, etc.

The camera shutter button 16 is shown to differentiate between the right and left side faces of the cabinet 10, and the camera function and the shutter button thereof are not essential elements for the present disclosure.

Figure 2A:
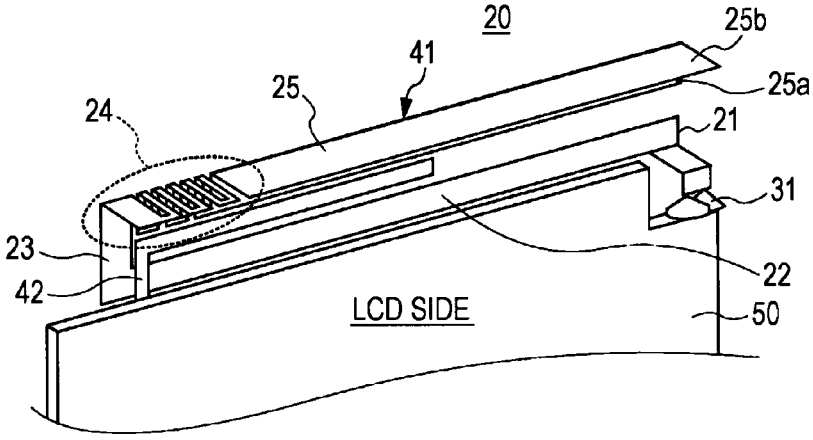
FIGS. 2(*a*), 2(*b*), and 2(*c*) are a perspective view and a plan view of the schematic configuration, and a diagram showing the electrical connection structure of a GPS antenna 20 of a mobile terminal 100 of the present embodiment, respectively.
Figure 2B:
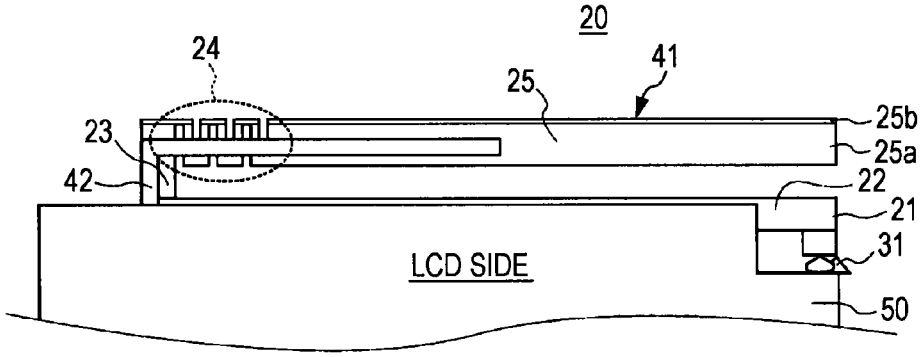
Figure 2C:
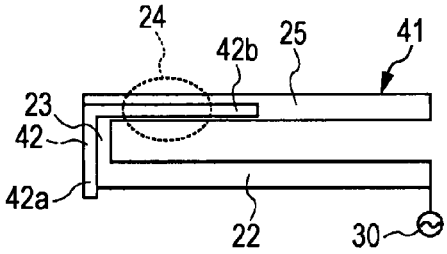

FIGS. 2(*a*), 2(*b*), and 2(*c*) are a perspective view and a plan view of the schematic configuration, and a diagram indicating the electrical connection structure of the GPS antenna 20 of the mobile terminal 100 of the present embodiment, respectively. FIG. 2(*a*) is a diagram of a substrate 50 viewed from the front-face side, that is, the side where the LCD exists. The GPS antenna 20 includes a feeding element 41 which is an antenna element and a non-feeding element 42.

In this example, the feeding element 41 has a folded shape extending in the direction of the width of the upper part of the cabinet and includes a feeding point 30 provided on the upper-right end part of the substrate 50 shown in the diagram (see FIG. 2(*c*)). The feeding point 30 is connected to one end 21 of the feeding element 41 via a matching-circuit element 31. The feeding element 41, which is the antenna element of the GPS antenna 20, includes a strip-like part 23 extending upward via a strip-like part 22 extending from the one end 21 along the upper side of the substrate 50 and from the right end thereof to the vicinity of the left end. The strip-like part 23 includes a free-end part 25 which is folded back and is in parallel with the strip-like part 22. The free-end part 25 includes a part 25*a* provided on the same plane as that of the strip-like part 22 and an overhanging part 25*b* which is bent and overhung at almost a right angle from the upper side thereof. In the vicinity of the base (the strip-like part 22) side of the free-end part 25, a so-called meander line part 24 folded in a crank-like manner is provided. However, the meander line part 24 is not an essential element for the present disclosure and may be flat-shaped. Further, the overhanging part 25*b* also is not an essential element for the present disclosure.

The non-feeding element 42 is a part provided to change the directivity of the GPS antenna 20. The non-feeding element 42 is provided near the feeding element 41 and is selectively grounded for GND of the substrate 50 as will be described later. The non-feeding element 42 includes a strip-like part 42*a* which is almost in parallel with the strip-like part 23 of the feeding element 41 and a strip-like part 42*b* that is bent at a right angle from the upper end thereof and that extends along the free-end part 25 of the feeding element 41.

Figure 3:
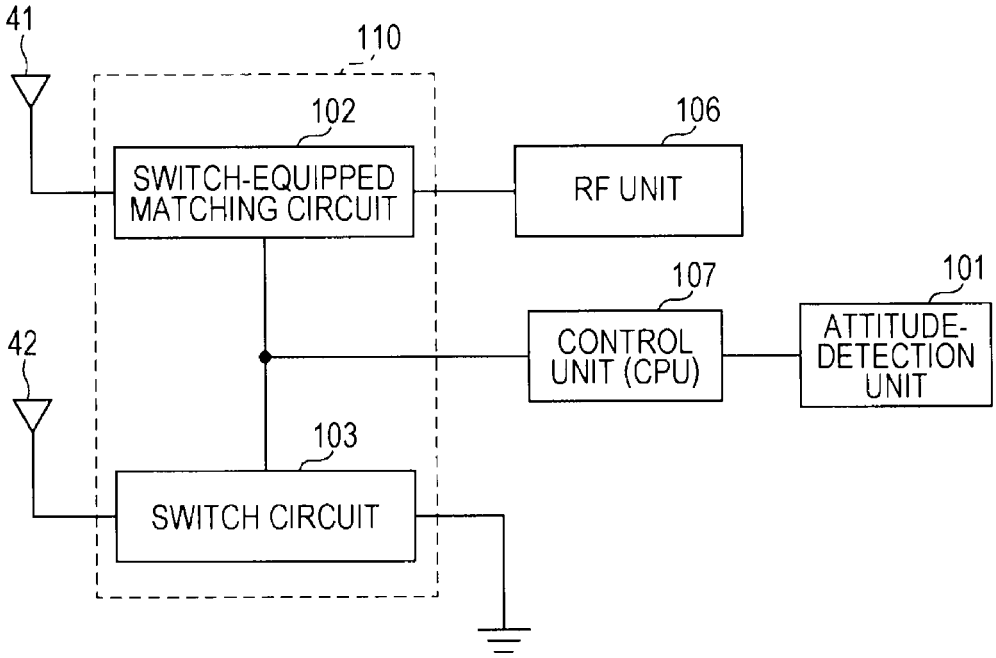
FIG. 3 shows an exemplary configuration of a control circuit of the GPS antenna of an embodiment of the present disclosure.

FIG. 3 indicates an exemplary configuration of a control circuit of the GPS antenna 20 of the present embodiment.

Electricity is supplied from an RF unit (radio-frequency unit) 106 to the feeding element 41 via a switch-equipped matching circuit 102. The RF unit 106 includes a known radiofrequency-signal reception circuit. The non-feeding element 42 is connected to the GND of the substrate via a switch circuit 103. The switch-equipped matching circuit 102 and the switch circuit 103 are controlled with a control unit 107 including a CPU. Hereinafter, the switch-equipped matching circuit 102 and the switch circuit 103 are referred to as a matching-circuit unit 110. The control unit 107 controls the switch-equipped matching circuit 102 and the switch circuit 103 based on an output of an attitude-detection unit 101. The attitude-detection unit 101 is provided to identify the vertical state and the horizontal state of the mobile terminal 100, and includes, for example, an acceleration sensor. The "vertical state" is the holding state where a user determines the length direction of the cabinet to be a vertical direction for the user oneself (also referred to as a vertical-holding state). The "horizontal state" is the holding state where the user makes the length direction of the cabinet point in a horizontal direction with respect to the user oneself (also referred to as a horizontal-holding state). Basically, the attitude-detection unit 101 detects the inclination angle of the mobile terminal and generates a binary output (High and Low) based on whether or not the angle is not greater than a specified threshold value. When the angle is not smaller than the specified threshold value, a determination is made that it is the horizontal state, otherwise a determination is made that it is the vertical state.

As the attitude-detection unit 101, any sensor other than the acceleration sensor, such as a gyro sensor may be used so long as the inclination of the main body part of the terminal (the cabinet) can be detected. The inclination of the cabinet is calculated based mainly on the angle of rotation centered on an axis perpendicular to the image screen. Further, depending on the embodiments, an arbitrary sensor output that allows for analogizing the inclination may be used instead of detecting the inclination directly. For example, when the lower cabinet including a full keyboard of a mobile terminal of the above-described horizontal sliding type is drawn out, it is estimated that the mobile terminal is in the horizontal state at that time. In that case, a sensor detecting the presence or absence of the draw of the lower cabinet may be used as the attitude-detection unit 101.

Figure 4B:
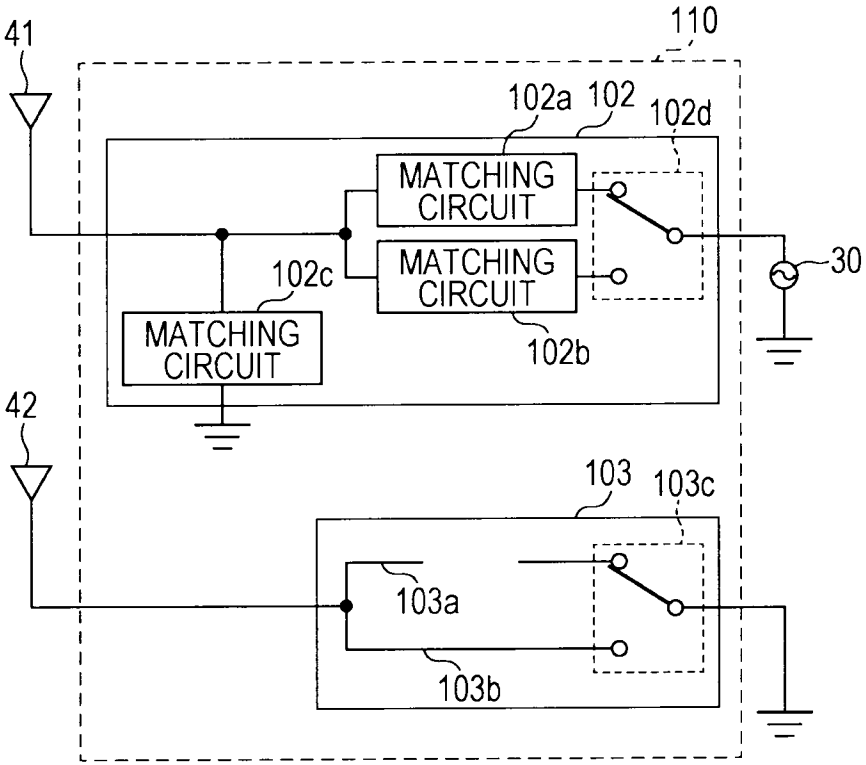
FIGS. 4(*a*) and 4(*b*) show the appearance of the mobile terminal which is the vertical state, and the internal configuration of a matching-circuit unit and a switch-changing state attained in that state, respectively.
Figure 4A:
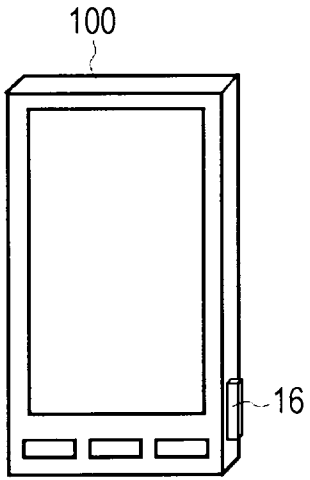

FIGS. 4(*a*) and 4(*b*) show the appearance of the mobile terminal 100 which is in the vertical state, and the internal configuration of the matching-circuit unit 110 and a switch-changing state attained in that state, respectively.

As shown in FIG. 4(*b*), the switch-equipped matching circuit 102 includes a first matching circuit 102*a*, a second matching circuit 102*b*, and a third matching circuit 102*c*, and a switch 102*d* (a first switch). The switch 102*d* includes a single-pole double-through switch and functions to switch and connect the feeding point 30 (corresponding to the RF unit 106) to the first and second matching circuits 102*a* and 102*b* selectively. In the vertical state shown in FIG. 4(*a*), the switch 102 selects the first matching circuit 102*a*. The third matching circuit 102*c* is commonly connected to the first and second matching circuits 102*a* and 102*b*.

The switch circuit 103 includes a cut line (break part) 103*a*, a through line (lead part) 103*b*, and a switch 103*c* (a second switch). The switch 103*c* includes a single-pole double-through switch and functions to selectively ground the non-feeding element 42 to the GND of the substrate.

The directivity of the GPS antenna 20 can be changed by selecting whether or not the non-feeding element 42 is grounded to the substrate with the switch 103*c*. A shift of the resonance frequency (1575 MHz) of the feeding element 41 occurs when the non-feeding element 42 is grounded due to the change made with the switch 103*c*. Accordingly, a changeover between the first and second matching circuits 102*a* and 102*b* is made by switching the switch 102*d* in synchronization with the change made with the switch 103*c*, so that the frequency shift is compensated.

According to the configuration, an output High is generated from the attitude-detection unit 101 and the switch 102*d* selects the matching circuit 102*a* when the mobile terminal 100 is in the vertical state, as shown in FIG. 4(*a*). Concurrently with that, the switch 103*c* of the non-feeding element 42 selects the cut line 103*a* so that the non-feeding element 42 is not grounded to the GND of the substrate. As a consequence, the non-feeding element 42 does not operate and only the feeding element 41 operates.

Figure 5A:
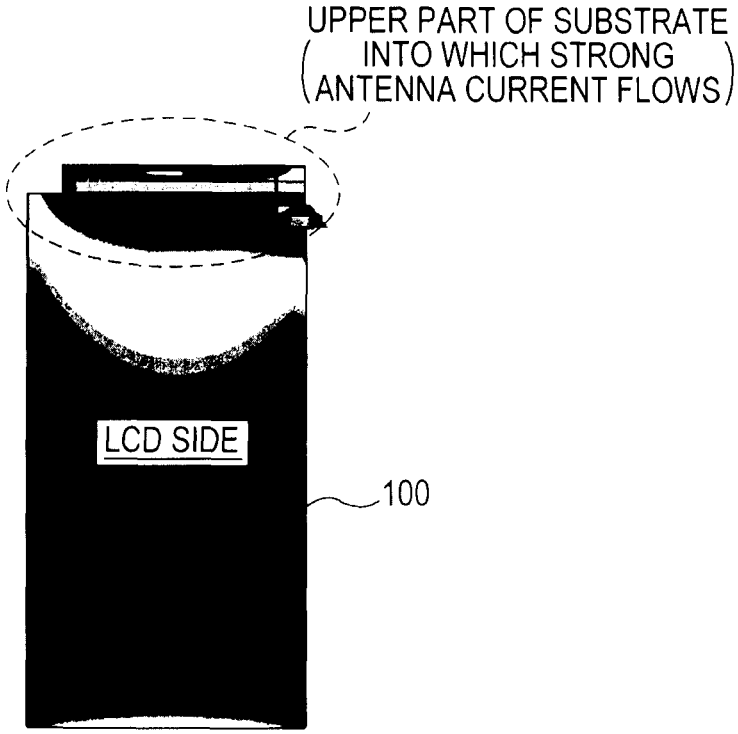
FIGS. 5(*a*) and 5(*b*) show the distribution of antenna currents and the then GPS directivity of the mobile terminal which is in the vertical state shown in FIGS. 4(*a*) and 4(*b*).
Figure 5B:
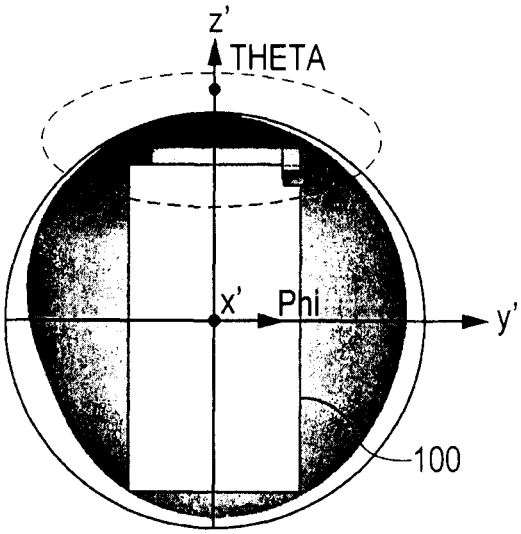

FIGS. 5(*a*) and 5(*b*) show the distribution of antenna currents and the then GPS directivity of the mobile terminal 100 which is in the vertical state shown in FIGS. 4(*a*) and 4(*b*). Strongly flowing part of the antenna currents appears in the upper part of the substrate which is in the vertical state. As a consequence, the GPS directivity is aimed at the upper side of the mobile terminal 100 which is in the vertical state (the sky) as shown in FIG. 5(*b*). Accordingly, it is expected that the sensitivity of reception of a radio wave transmitted from a GPS satellite becomes favorable.

Figure 6:
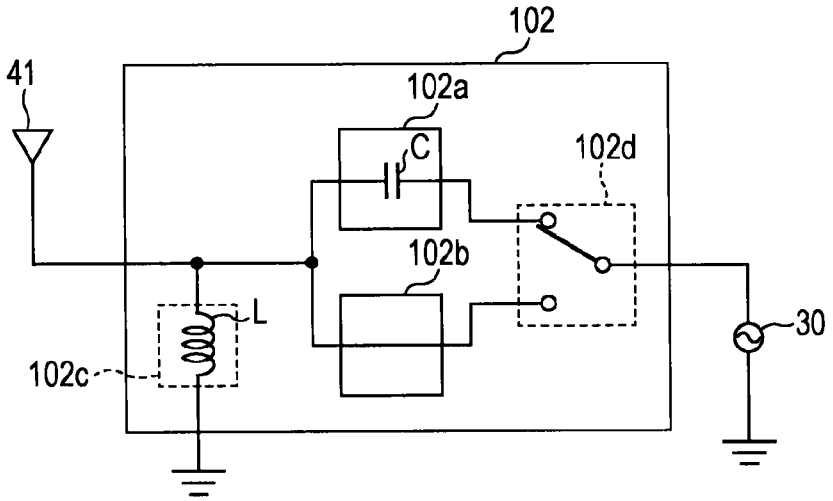
FIG. 6 shows an exemplary specific configuration of a switch-equipped matching circuit.

FIG. 6 shows an exemplary specific configuration of the switch-equipped matching circuit 102. The first matching circuit 102*a* may include a capacitor C, the second matching circuit 102*b* may include a simple through line, and the third matching circuit 102*c* may include an inductor L.

Figure 7:
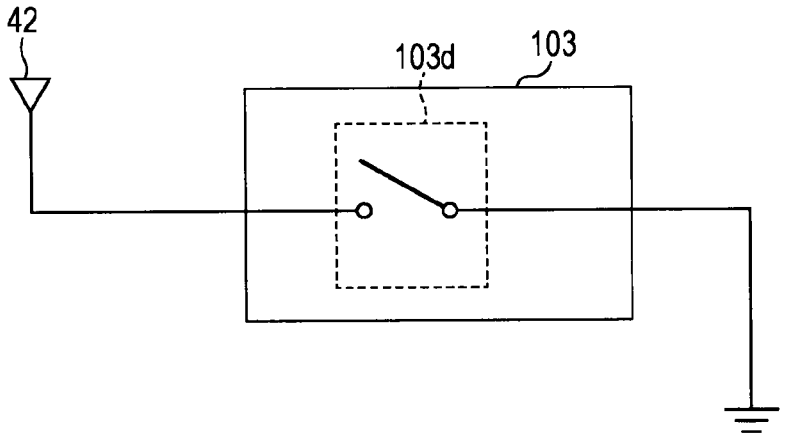
FIG. 7 shows an exemplary specific configuration of a switch circuit.

FIG. 7 shows an exemplary specific configuration of the switch circuit 103. The switch circuit 103 may only include a single-pole single-through switch 103*d*.

Figure 8B:
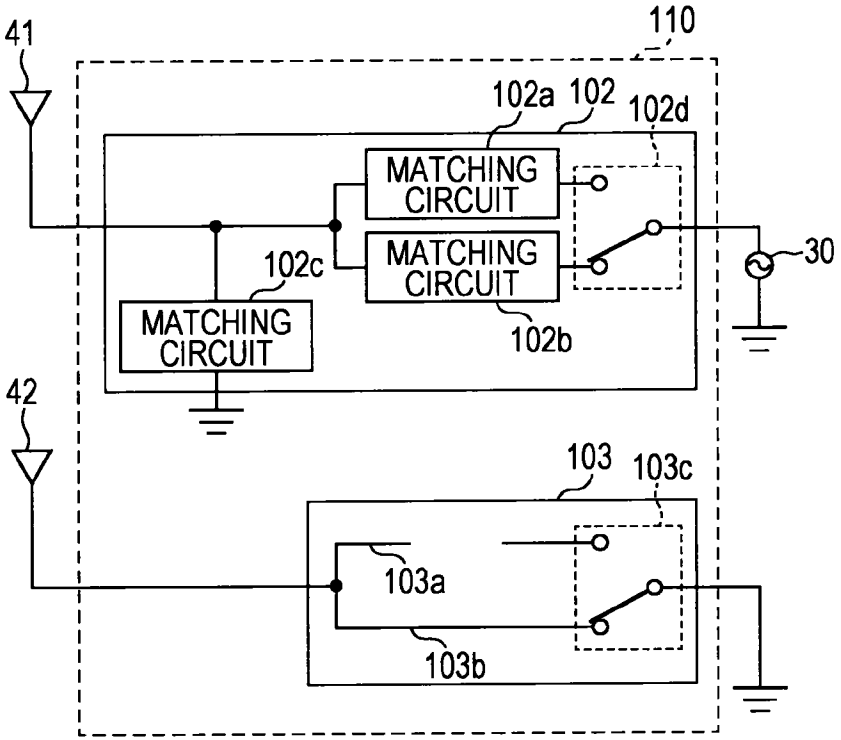
FIGS. 8(*a*) and 8(*b*) show the appearance of the mobile terminal which is in the horizontal state, and the internal configuration of the matching-circuit unit and a switch-changing state attained in that state, respectively.
Figure 8A:
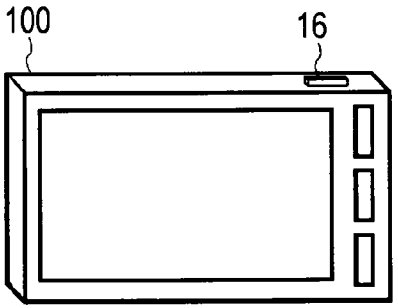

FIGS. 8(*a*) and 8(*b*) show the appearance of the mobile terminal 100 which is in the horizontal state, and the internal configuration of the matching-circuit unit 110 and a switch-changing state attained in that state, respectively. FIG. 8(*b*) is different from FIG. 4(*b*) in that the changing states of the switch 102*d* and the switch 103*c* are opposite to those of FIG. 4(*b*). In that case, an output Low is generated from the attitude-detection unit 101. Accordingly, the switch 102*d* provided for the feeding element 41 selects the matching circuit 102*b*, and the switch 103*c* provided for the non-feeding element 42 selects the through line 103*b* at the same time. Consequently, the non-feeding element 42 is grounded to the GND of the substrate and operates as a non-feeding element. Therefore, the antenna current strongly flows into a substrate side part on the sky-side due to operations of both the feeding element 41 and the non-feeding element 42 of the GPS antenna 20, and a radio wave is emitted therefrom. As a consequence, it becomes possible to rotate the directivity obtained in the vertical state about 90 degrees and aim the directivity in the sky direction which is the target direction. That is, it becomes possible to aim the GPS directivity at the sky even though the mobile terminal 100 takes an attitude shown in FIG. 8(*a*).

Figure 9A:
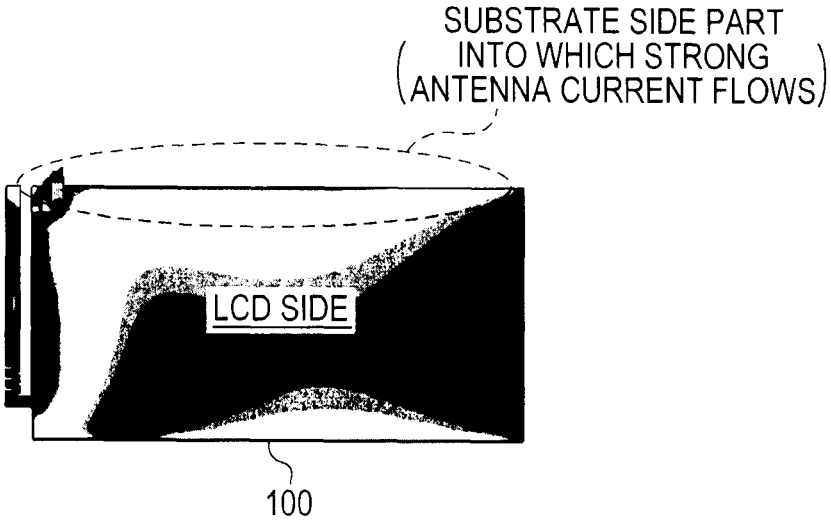
FIGS. 9(*a*) and 9(*b*) show the distribution of antenna currents and the then GPS directivity of the mobile terminal which is in the horizontal state shown in FIGS. 8(*a*) and 8(*b*).
Figure 9B:
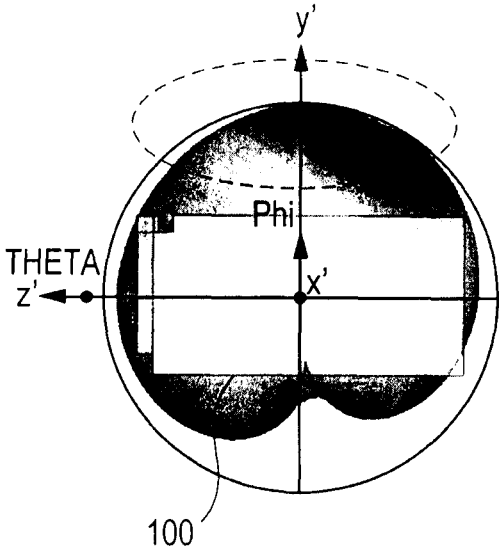

FIGS. 9(*a*) and 9(*b*) show the distribution of antenna currents and the then GPS directivity of the mobile terminal 100 which is in the horizontal state shown in FIGS. 8(*a*) and 8(*b*). Strongly flowing part of the antenna currents appears in the upper part of the substrate which is in the horizontal state (that is, a substrate side part 17 in the vertical state). As a consequence, the GPS directivity is aimed at the upper side of the mobile terminal 100 which is in the horizontal state (the sky) as shown in FIG. 9(*b*). Accordingly, it is expected that the sensitivity of reception of a radio wave transmitted from the GPS satellite becomes favorable.

Figure 10B:
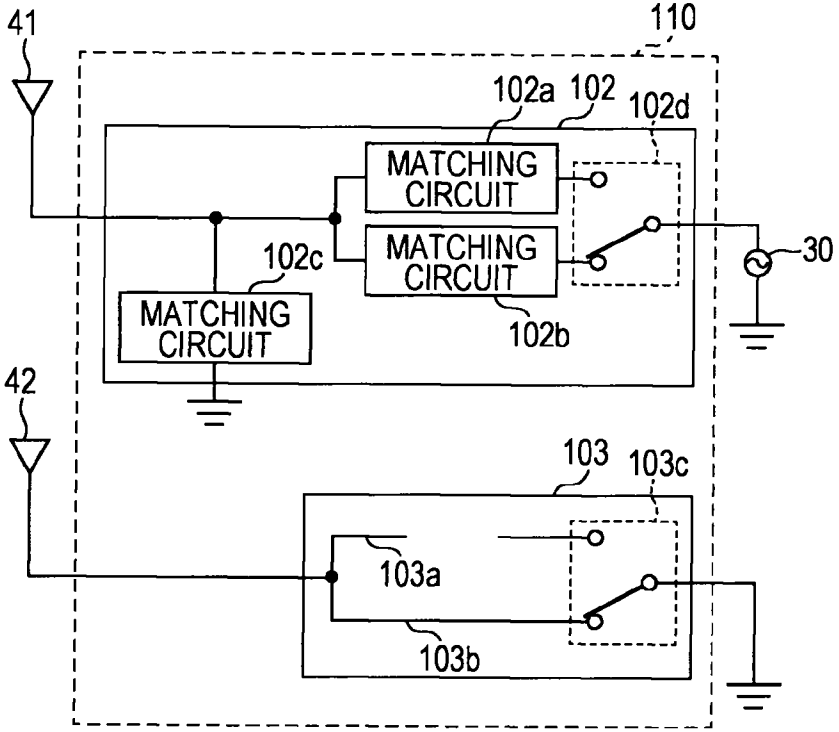
FIGS. 10(*a*) and 10(*b*) show the appearance of the mobile terminal 100 which is in the horizontal state, and the internal configuration of the matching-circuit unit and a switch-changing state attained in that state, respectively, as is the case with FIGS. 8(*a*) and 8(*b*).
Figure 10A:
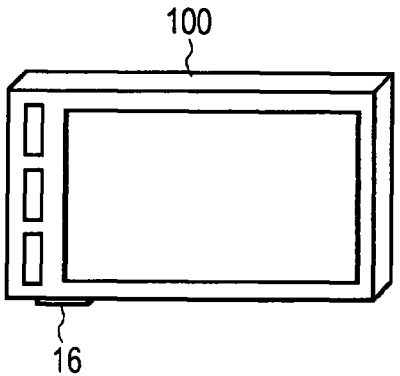

As is the case with FIGS. 8(*a*) and 8(*b*), FIGS. 10(*a*) and 10(*b*) show the appearance of the mobile terminal 100 which is in the horizontal state, and the internal configuration of the matching-circuit unit 110 and a switch-changing state attained in that state, respectively. However, according to the horizontal states of FIG. 10(*a*) and FIG. 8(*a*), terminal side faces which become the sky sides are opposite to each other as is clear from the positions of the shutter button 16. In this specification, the horizontal state shown in FIG. 8(*a*) is referred to as a first horizontal state and the horizontal state shown in FIG. 10(*a*) is referred to as a second horizontal state. Although not shown, the top and the bottom of the antenna current distribution shown in FIG. 9(*a*) need to be reversed in the second horizontal state.

The point where the non-feeding element 42 is grounded needs to be changed, to change the antenna current distribution achieved in the first and second horizontal states.

Figure 11A:
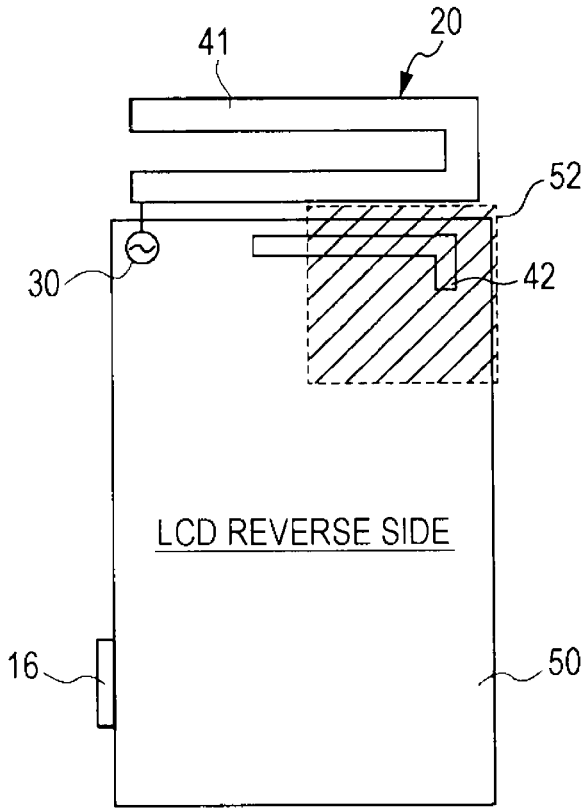
FIGS. 11(*a*) and 11(*b*) are a rear elevational view and a side view showing the area of a GND-grounding spot of a non-feeding element, which is appropriate for a first horizontal state.
Figure 11B:
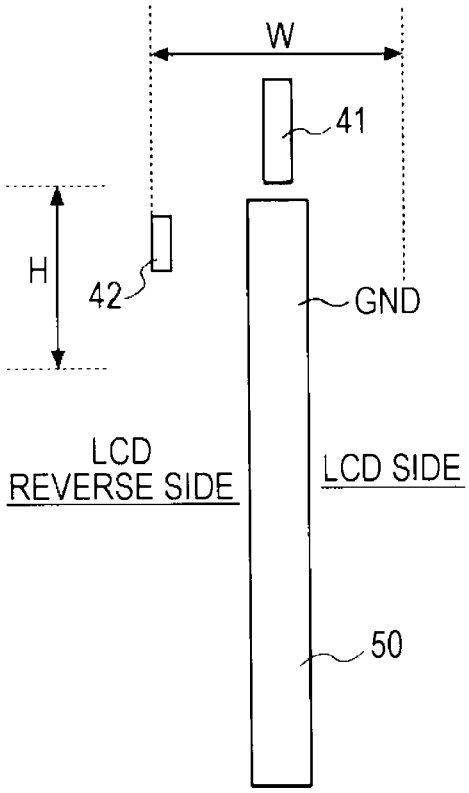

FIG. 11(*a*) shows an area 52 of the GND-grounding point of the non-feeding element 42 is grounded, which is appropriate for the first horizontal state where the shutter button 16 is on the upper side shown in FIG. 8. FIG. 11(*a*) is a rear elevational view of the substrate 50 viewed from the rear-elevation side, that is, the side where no LCD exists. FIG. 11(*b*) is the side view thereof. The area 52 defined on the substrate 50, where the non-feeding element 42 is grounded, is in the proximity of the upper side of the substrate 50 where the feeding element 41 is provided and an area defined on the side near the earth's surface in the first horizontal state. Consequently, the current distribution shown in FIG. 9(*a*) is obtained.

Figure 12A:
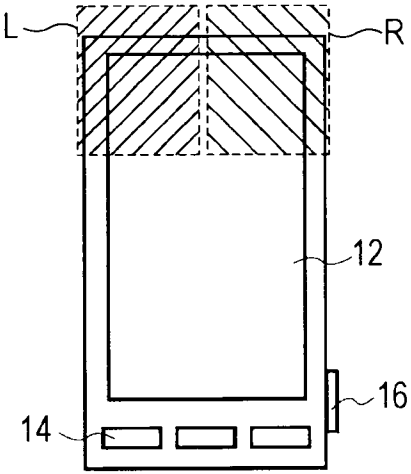
FIGS. 12(*a*), 12(*b*), and 12(*c*) are diagrams that are provided to describe the grounding area of the non-feeding element, which is appropriate for the first horizontal state and a second horizontal state.
Figure 12B:
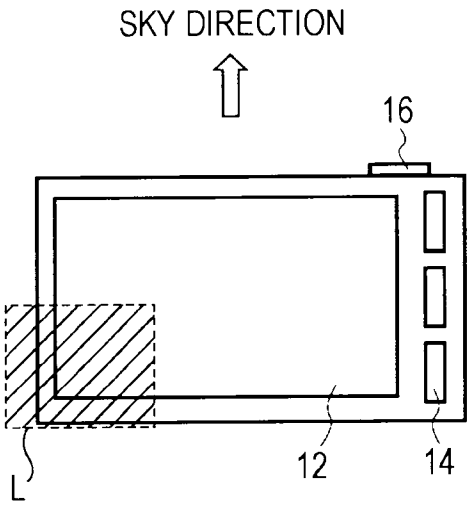
Figure 12C:
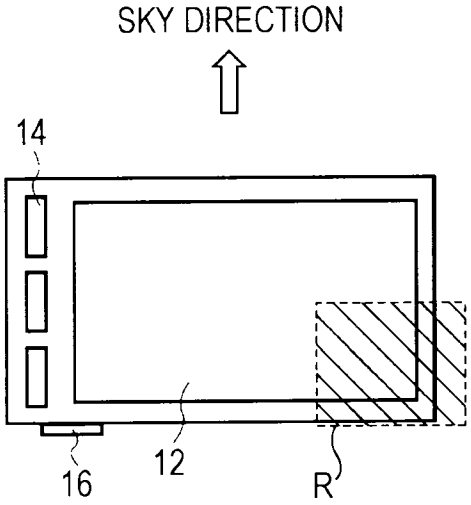

FIGS. 12(*a*), 12(*b*), and 12(*c*) are diagrams provided to describe the grounding area of the non-feeding element 42, which is appropriate for the first and second horizontal states. FIG. 12(*b*) indicates the first horizontal state. In that state, the grounding area of the non-feeding element 42 is an area L defined on an upper-left part of the cabinet toward the image screen of the LCD 12 when the terminal is in the upright state shown in FIG. 12(*a*). FIG. 12(*c*) indicates the second horizontal state. In that state, the grounding area of the non-feeding element 42 is an area R defined on an upper-right part of the cabinet toward the image screen of the LCD 12 when the terminal is in the upright state shown in FIG. 12(*a*).

It is important that a preferable grounding area of the non-feeding element 42 be an area defined on the side of the earth's surface, which is opposite to the sky, in any horizontal state. When a single non-feeding element 42 is used, the areas L and R are not compatible. Therefore, when the user holds each type of the mobile terminal 100, either of the areas is adopted based on which of the first and second horizontal states is selected or recommended.

Figure 13:
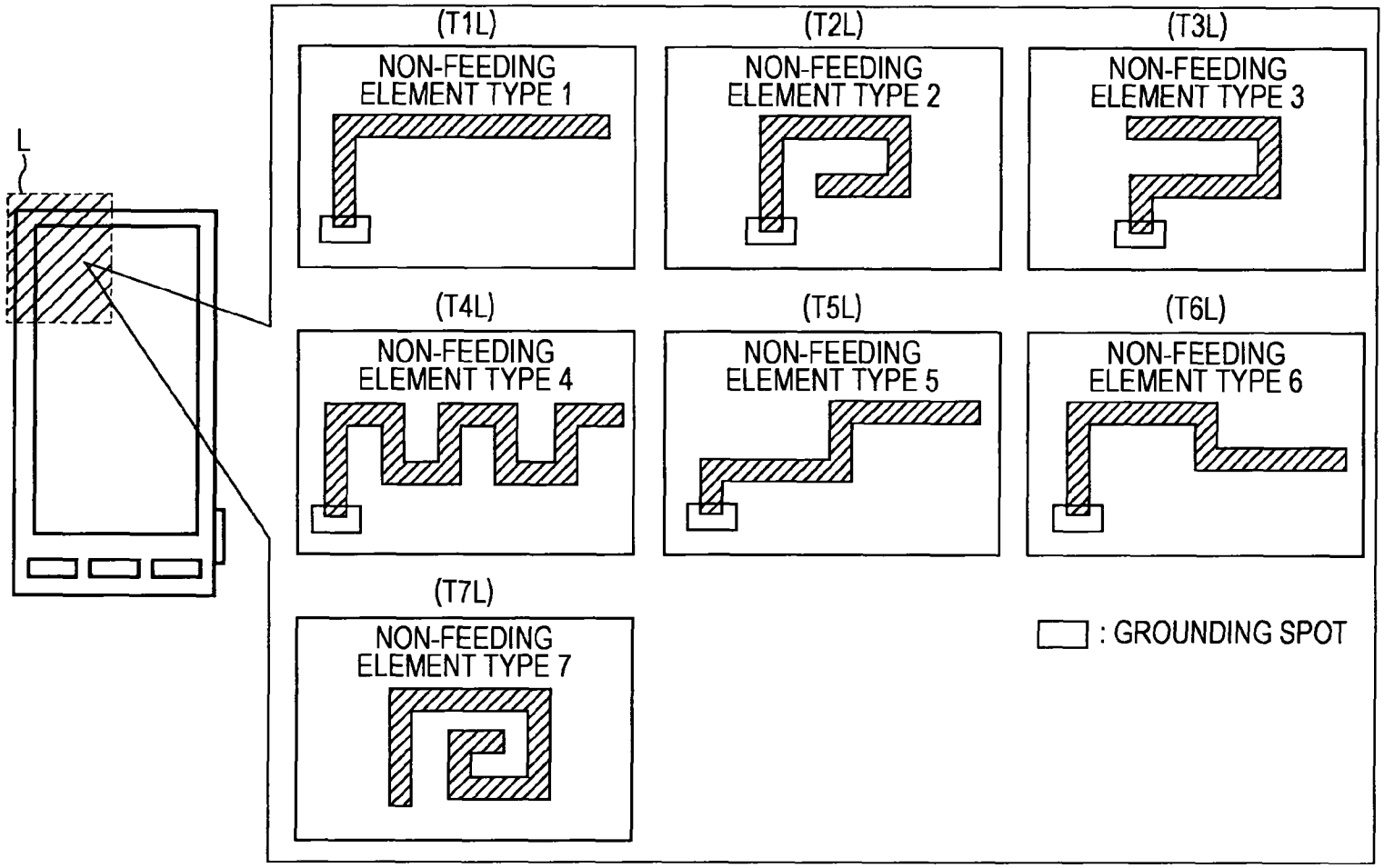
FIG. 13 shows various types of form patterns of the non-feeding element, which are used when an area L is adopted as the grounding area of the non-feeding element.

FIG. 13 shows various types of form patterns of the non-feeding element when the area L is adopted as the grounding area of the non-feeding element 42. Here, form patterns of seven adoptable types T1L to T7L are shown. The form pattern adoptable for the non-feeding element 42 is not limited thereto, but another form pattern can further be adopted. Although various forms can be adopted for the non-feeding element 42 as can be seen from the drawing, what is observed in the various forms in common is that a grounding spot (shown as a square frame in the drawing) is provided at a position near the side of the left-side face of the terminal which is in the upright state. In that case, the installation spot is positioned near the earth's surface side in the first horizontal state.

Figure 14:
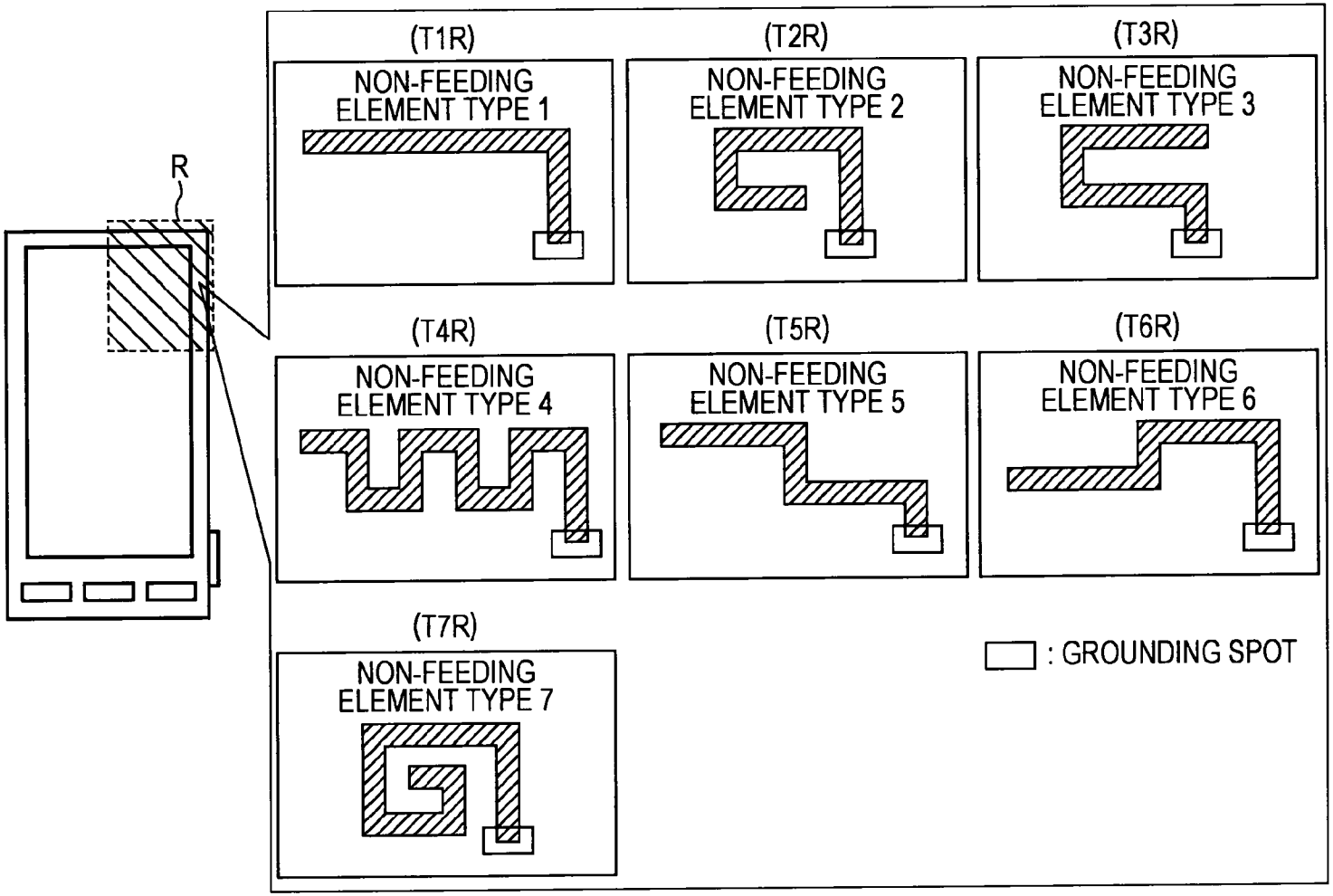
FIG. 14 shows various types of form patterns of the non-feeding element, which are used when an area R is adopted as the grounding area of the non-feeding element.

FIG. 14 shows various types of form patterns of the non-feeding element when the area R is adopted as the grounding area of the non-feeding element 42. Here, form patterns of seven adoptable types T1R to T7R are shown. These form patterns are obtained by laterally inverting the corresponding form patterns that are shown in FIG. 13. Although various forms can be adopted for the non-feeding element 42 as can be seen from the drawing, what is observed in the various forms in common is that the grounding spot is provided at a position near the side of the right-side face of the terminal which is in the upright state. In that case, the installation spot is positioned near the earth's surface side in the second horizontal state.

Thus, according to a first embodiment, the non-feeding element 42 is provided directly below or near the feeding element 41 of the GPS antenna 20 so that the directivity of the GPS antenna 20 can be changed in either of the vertical state and the horizontal state in an installation space almost the same as the installation space of a known single GPS antenna.

Next, an exemplary modification of the first embodiment will be described with reference to FIGS. 15 to 19. The exemplary modification allows for aiming the directivity of the GPS antenna at the sky in either of the first and second horizontal states.

Figure 15:
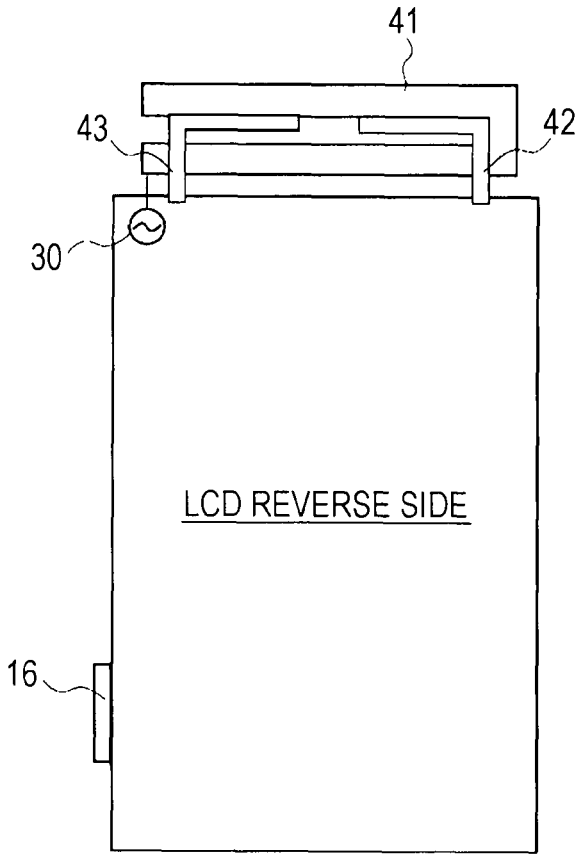
FIG. 15 shows an exemplary modification of a first embodiment.
Figure 16:
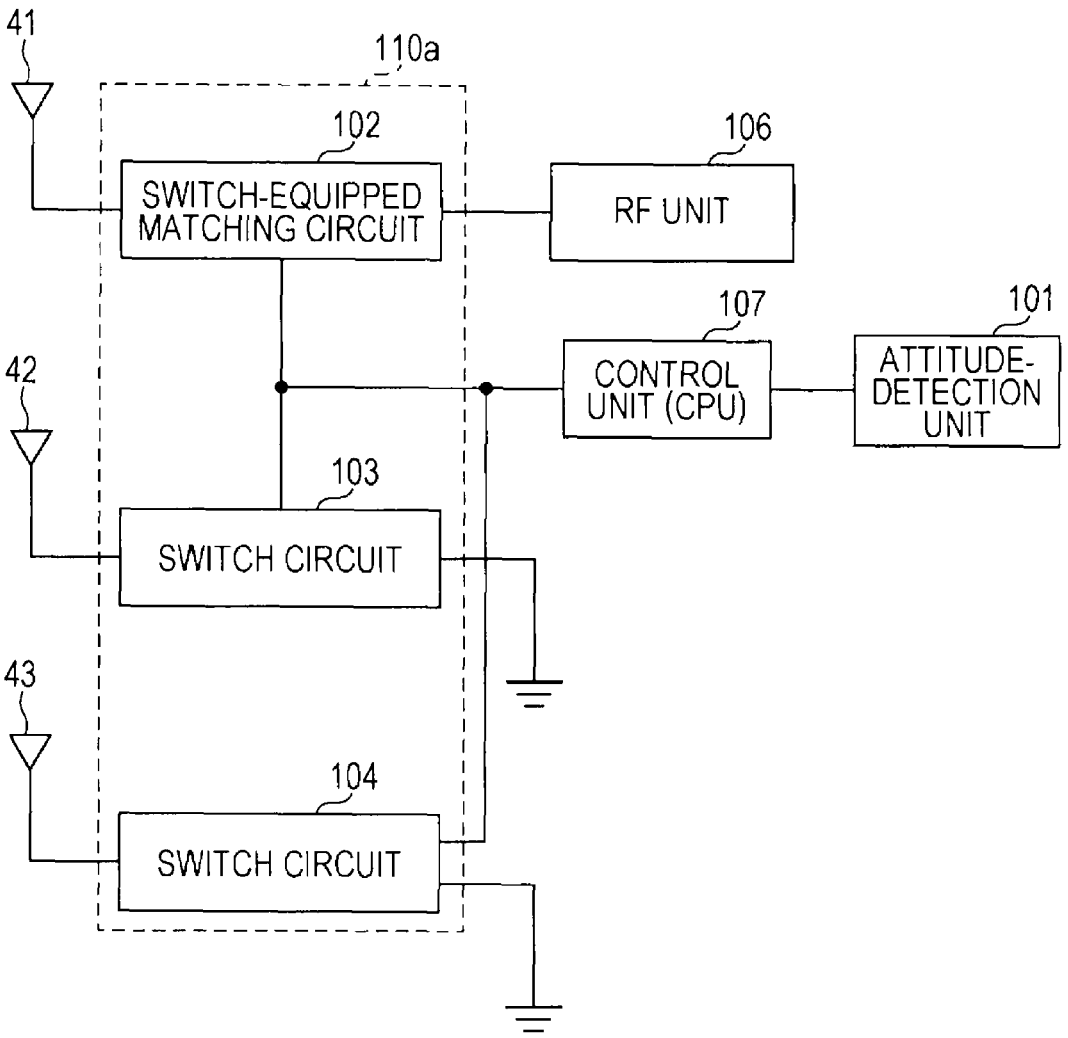
FIG. 16 shows an exemplary configuration of a control circuit of the GPS antenna used in the exemplary modification shown in FIG. 15.

Therefore, a second non-feeding element 43 is provided in addition to the first non-feeding element 42, and the first non-feeding element 42 and the second non-feeding element 43 are arranged in the above-described individual areas R and L as shown in FIG. 15. Further, as shown in FIG. 16, a switch circuit 104 is added to the above-described matching circuit 110 as a matching-circuit unit 110*a*. That switch circuit 104 is also controlled with the control unit 107. Further, not only a discrimination between the vertical state and the horizontal state is made, but also that between the first and second horizontal states is made based on an output of the attitude-detection unit 101. The sign (positive or negative) of the inclination of the cabinet is also confirmed therefor. That is, the three values of the vertical state where the angle of the inclination is not more than a specified value, the first horizontal state where the angle of the inclination exceeds a positive specified value, and the second horizontal state where the angle of the inclination exceeds a negative specified value are determined.

Figure 17B:
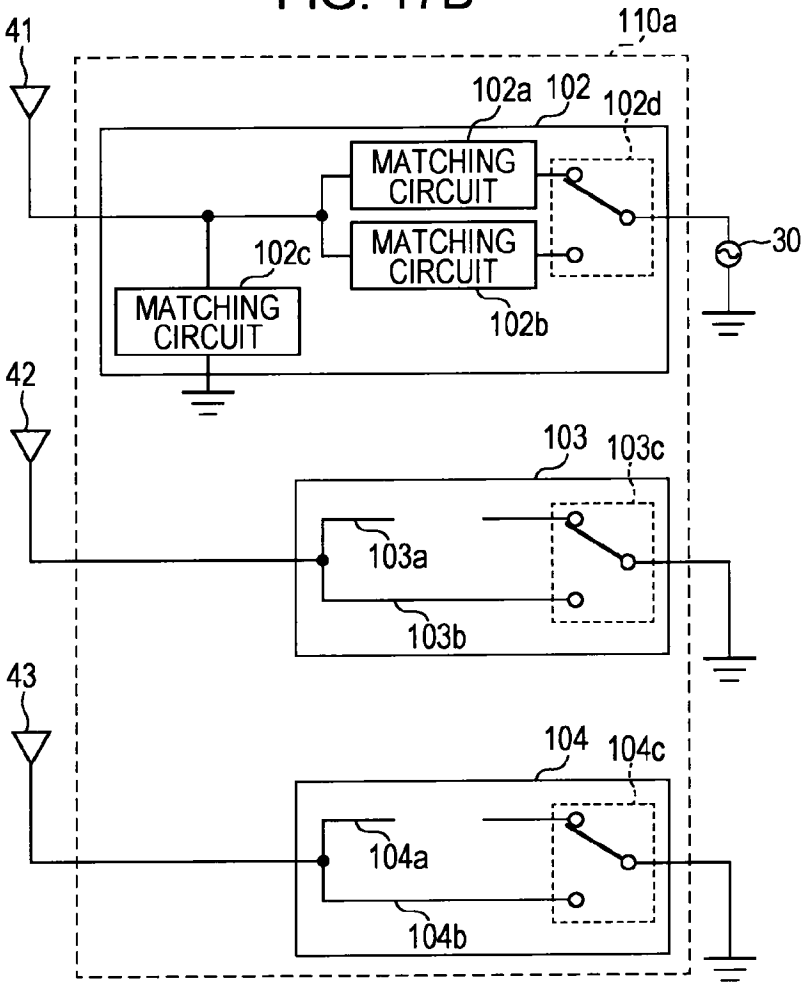
FIGS. 17(*a*) and 17(*b*) show the appearance of the mobile terminal which is in the vertical state, and the internal configuration of the matching-circuit unit and a switch-changing state attained in that state, which are observed in the exemplary modification shown in FIG. 15, respectively.
Figure 17A:
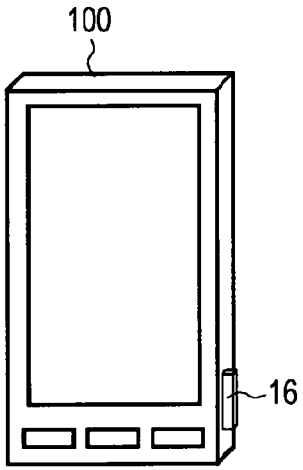

As shown in FIG. 17(*b*), the switch circuit 104 provided for a third non-feeding element 43 is a circuit which is substantially the same as the switch circuit 103, and includes a cut line 104*a*, a through line (lead) 104*b*, and a switch 104 (third switch). The switch 104*c* includes a single-pole double-through switch and functions to selectively ground the non-feeding element 43 to the GND of the substrate.

When the mobile terminal 100 is in the vertical state as shown in FIG. 17(*a*), the switch 102*d* selects the matching circuit 102*a* based on an output of the attitude-detection unit 101, and the switch 103*c* of the non-feeding element 42 selects the cut line 103*a* at the same time. Further, the switch 104*c* of the non-feeding element 43 selects the cut line 104*c*. Accordingly, the non-feeding element 42 and the non-feeding element 43 are not grounded to the GND of the substrate. At that time, the non-feeding element 42 and the non-feeding element 43 do not operate, and the GPS directivity can be aimed at the sky by passing a strong antenna current through the upper part of the substrate and emitting a radio wave therefrom by the operation only of the feeding element 41 of the GPS antenna 20.

Figure 18B:
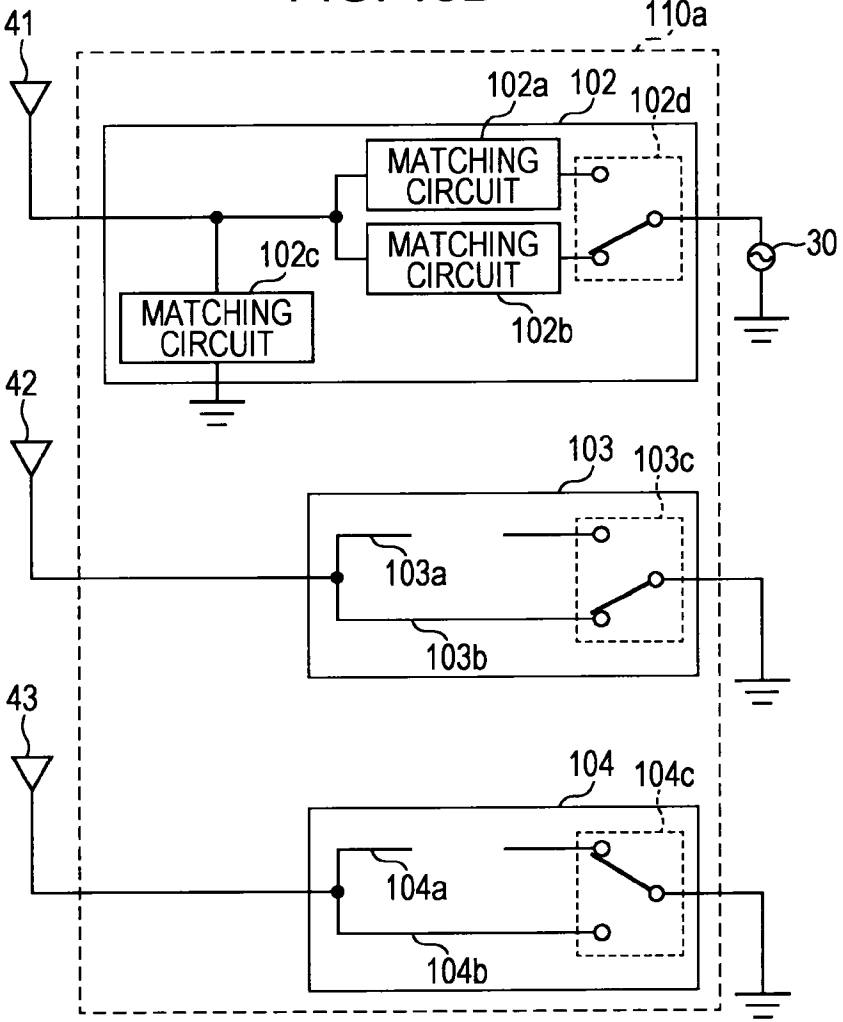
FIGS. 18(*a*) and 18(*b*) show the appearance of the mobile terminal which is in the first horizontal state, and the internal configuration of the matching-circuit unit and a switch-changing state attained in that state, which are observed in the exemplary modification shown in FIG. 15, respectively.
Figure 18A:
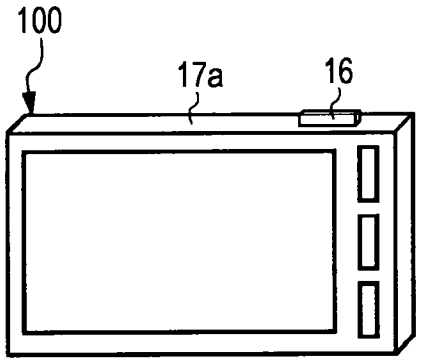

Next, when the mobile terminal 100 is in the first horizontal state where the shutter button 16 is at the top as shown in FIG. 18, the switch 102*d* selects the matching circuit 102*b* based on an output of the attitude-detection unit 101, the switch 103*c* of the non-feeding element 42 selects the through line 103*b* concurrently with that, and the switch 104*c* of the non-feeding element 43 selects the cut line 104*a*. Accordingly, the non-feeding element 42 is grounded to the GND of the substrate and the non-feeding element 43 is not grounded to the GND of the substrate. At that time, the non-feeding element 42 operates, and a strong antenna current is allowed to pass through the side of a substrate side part 17*a* and a radio wave is emitted therefrom as is the case with FIG. 9(*a*) with the operations of both the feeding element 41 and the non-feeding element 42 so that the GPS directivity can be aimed at the sky even though the mobile terminal 100 takes the attitude of the first horizontal state shown in FIG. 18(*a*).

Figure 19B:
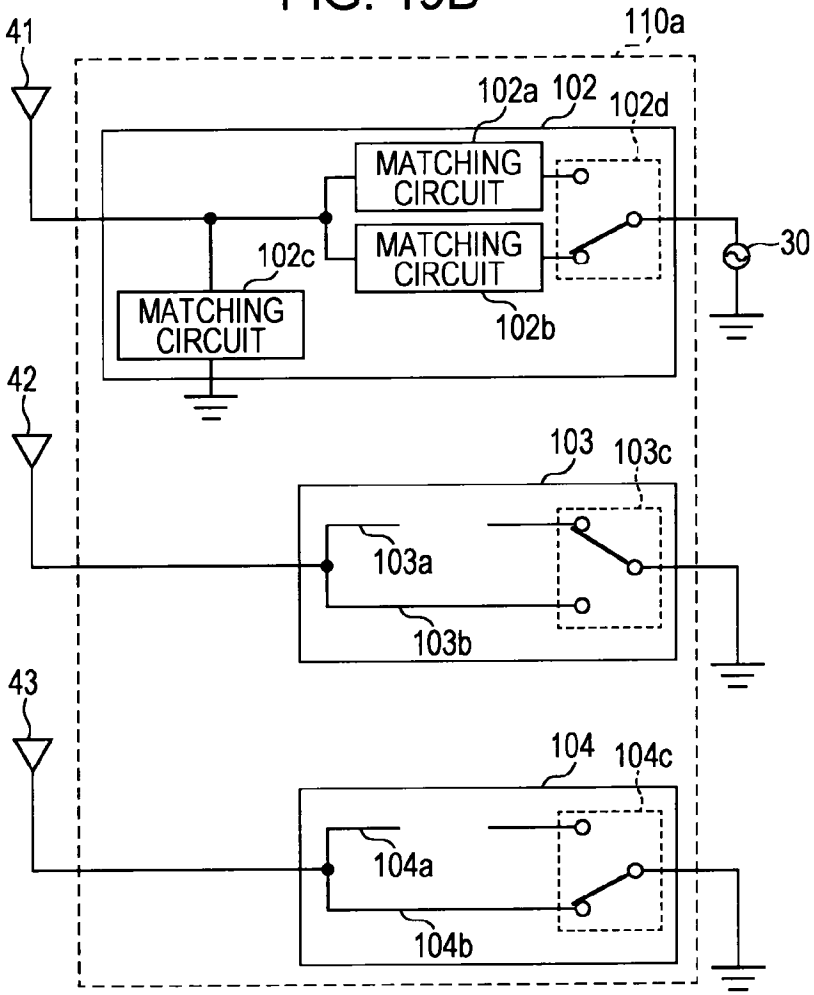
FIGS. 19(*a*) and 19(*b*) show the appearance of the mobile terminal which is in the second horizontal state, and the internal configuration of the matching-circuit unit and a switch-changing state attained in that state, which are observed in the exemplary modification shown in FIG. 15, respectively.
Figure 19A:
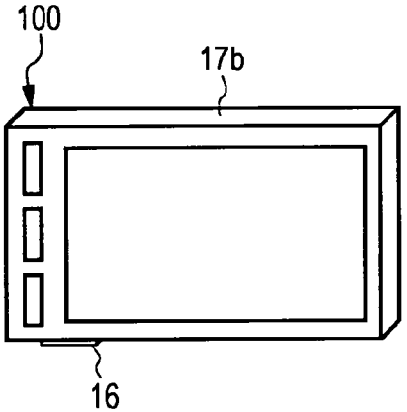

Next, when the mobile terminal 100 is in the second horizontal state where the shutter button 16 is at the bottom as shown in FIG. 19, the switch 102*d* selects the matching circuit 102*b* based on an output of the attitude-detection unit 101. At the same time, the switch 103*c* of the non-feeding element 42 selects the cut line 103*a*, the non-feeding element 42 is not grounded to the GND of the substrate, and the switch 104*c* of the non-feeding element 43 selects the through line 104*b*. Accordingly, the non-feeding element 42 does not operate and the non-feeding element 43 operates. As a consequence, a strong antenna current is allowed to pass through the side of a substrate side part 17*b* and a radio wave is emitted therefrom as is the case with FIG. 9(*a*) with the operations of both the feeding element 41 and the non-feeding element 43 of the GPS antenna 20. Accordingly, the GPS directivity can be aimed at the sky even though the mobile terminal 100 takes the attitude of the second horizontal state shown in FIG. 19(*a*).

Therefore, according to the exemplary modification of the first embodiment, the directivity of the GPS antenna 20 can be aimed at the sky in either of the case where the camera shutter button is at the top in the horizontal state and the case where the camera shutter button is at the bottom in the horizontal state.

Next, a second embodiment of the present disclosure will be described.

Figure 20A:
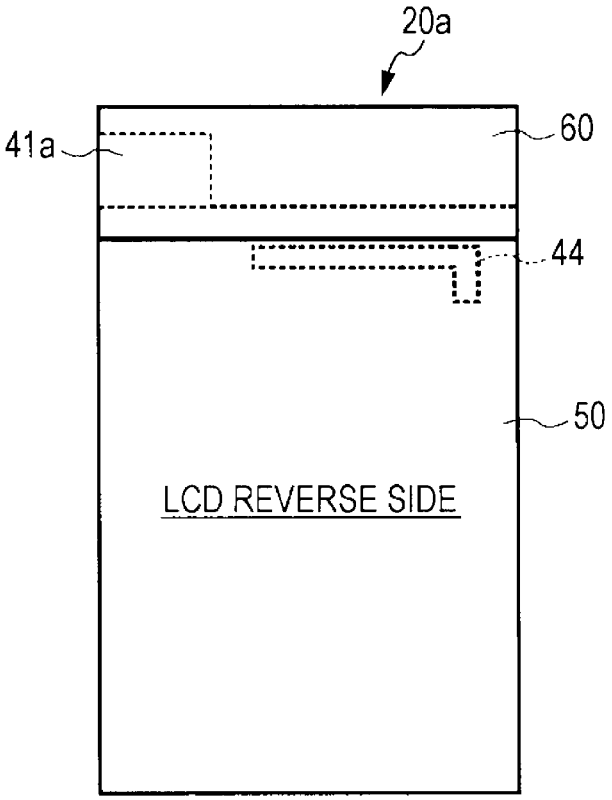
FIGS. 20(*a*) and 20(*b*) are a rear elevational view and a side view, respectively, which show an exemplary configuration of a GPS antenna 20*a* according to a second embodiment of the present disclosure.
Figure 20B:
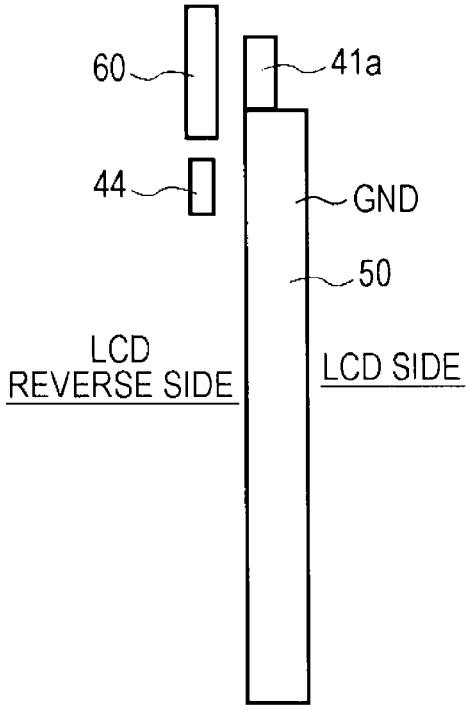

FIGS. 20(*a*) and 20(*b*) are a rear elevational view and a side view, respectively, which show an exemplary configuration of a GPS antenna 20*a* according to the second embodiment. Although the GPS antenna 20 shown in FIG. 2(*a*) is configured to extend over the almost entire width direction of the upper part of the cabinet, the feeding element 41*a* of the GPS antenna 20*a* shown in FIG. 20(*a*) is configured to be arranged and tilted toward an end of the direction of the width of the upper part of the cabinet. Therefore, the single feeding element 41*a* is often not sufficient to aim the directivity of the GPS antenna 20*a* at the sky. The GPS antenna 20*a* of the present embodiment is arranged near the rear of the feeding element 41*a* and includes a plate-like shaped non-feeding element 60 extending over the almost entire direction of the width of the cabinet. The non-feeding element 60 is provided to make an improvement so that the directivity of the GPS antenna 20*a*, the directivity being attained with the feeding element 41*a* which is in the vertical direction, is aimed at the sky, and is not grounded to the GND.

In the second embodiment, a non-feeding element 44 which is selectively connected to a specified grounding spot when being in the horizontal state is provided for the GPS antenna 20*a* having the above-described configuration. Although not specifically shown, provisions for the first and second horizontal states are the same as those of the first embodiment and the exemplary modification thereof. That is, in the second embodiment, the configurations and the grounding spots of the non-feeding elements, which are provided to make the provisions for the first and second horizontal states, can be adopted as described above.

Figure 21:
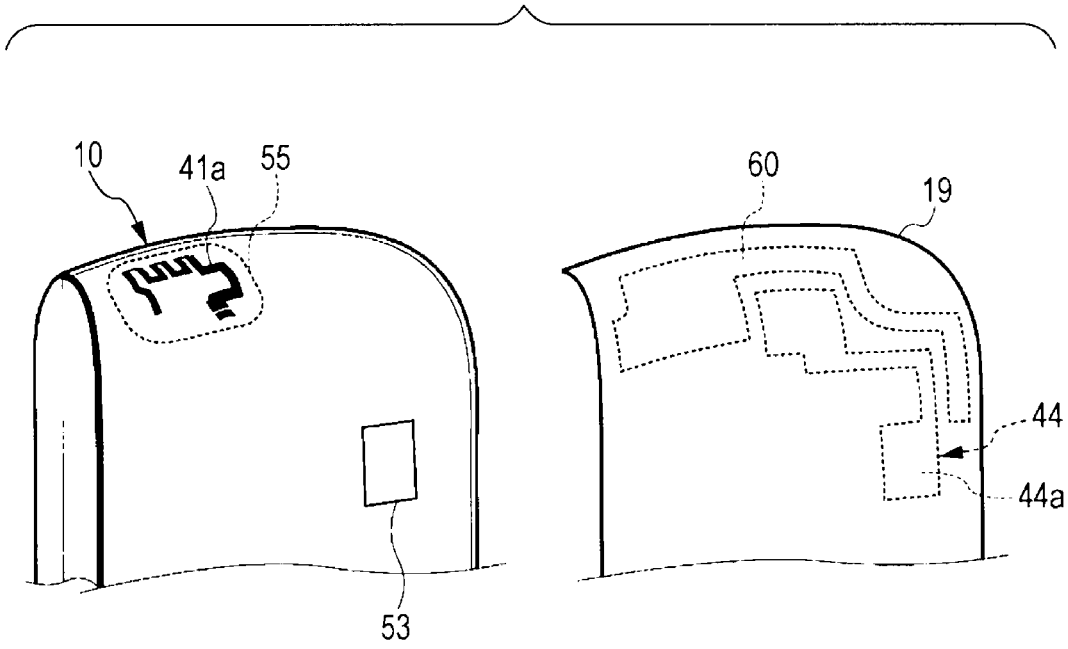
FIG. 21 shows an exemplary pattern and exemplary installation of an actual antenna element provided in the mobile terminal corresponding to the configuration of the second embodiment shown in FIG. 20.

FIG. 21 shows an exemplary pattern and exemplary installation of an actual antenna element provided in the mobile terminal corresponding to the configuration of the second embodiment shown in FIG. 20.

The feeding element 41 of the GPS antenna 20*a* is provided as part of an antenna unit 55 arranged inside the cabinet 10. The non-feeding elements 60 and 44 are formed as conductive patterns that are provided on (e.g., adhered to) the back face of a cabinet cover 19, so as to be substantially opposed to (or positioned near) the antenna unit 55 when the cabinet cover 19 of the cabinet is placed on the main body of the cabinet. The non-feeding element 44 is configured so that the lower-end part 44*a* thereof comes in contact with a contact point 53 provided on the substrate provided in the cabinet 10 when the cabinet cover 19 is placed on the main body of the cabinet. The contact can be performed directly or indirectly via, for example, a conductive elastic material (not shown), etc. The contact point 53 is selectively grounded to a grounding spot (GND) provided on the substrate via a switch (corresponding to 103*c*) on the substrate.

According to the above-described configuration, there is no need to increase the size of the antenna unit 55 itself. Further, the flexibility of selecting the place where the non-feeding element is arranged is high, and a special installation space is hardly needed for the non-feeding element.

Although not shown, the above-described configuration can also be used for the first embodiment. That is, the feeding element can be provided in an antenna unit arranged in the cabinet 10, and the non-feeding elements can be provided on the back face of the cabinet cover 19 as the conductive patterns. Particularly, even though the first and second non-feeding elements are used for the exemplary modification of the first embodiment, the installation space is hardly increased therefor.

The above-described configuration allows for avoiding an increase in the size of the antenna unit, the increase occurring due to the size and/or the arrangement of the non-feeding elements, and by extension an increase in the terminal size.

Although the preferred embodiments of the present disclosure have been described so far, various modifications and changes can be made in addition to the stated above. For example, the antenna can be designed by adjusting the element length of the antenna by separating the antenna element in the middle and providing a reactance element including an inductance, a capacitance, and so forth therebetween directly or through the use of a slave substrate. The design method can be applied for either of the feeding element and the non-feeding element. The spot where the reactance element is inserted is not limited to a single spot, but a plurality of spots may be provided. The connection between the antenna element and the reactance element (or the slave substrate) can be arbitrarily performed so long as an electrical and mechanical connection can be performed. For example, the connection can be directly performed with solder. When the slave substrate is used, it is possible to perform the connection so that there is the difference in height between the slave substrate with a spring connection.

What is claimed is:

1. A mobile terminal comprising:

an antenna device including an antenna element and a first non-feeding element;

a radio-frequency unit configured to receive a signal from the antenna element;

a first matching circuit connected to the antenna element;

a second matching circuit connected to the antenna element;

a first switch configured to selectively connect one of the first and second matching circuits to the radio-frequency unit;

a second switch configured to selectively ground the first non-feeding element;

an attitude-detection unit configured to detect an attitude of the mobile terminal; and a control unit configured to control the first and second switches based on an output of the attitude-detection unit.

2. The mobile terminal of claim 1, further comprising:

a third matching circuit connected to the first and second matching circuits.

3. The mobile terminal of claim 1, wherein the second switch is configured to selectively connect one of a cut line and the first non-feeding element to ground.

4. The mobile terminal of claim 1, wherein the first matching circuit includes a capacitor.

5. The mobile terminal of claim 1, wherein the second matching circuit is a through line directly connecting the antenna element and the radio-frequency unit.

6. The mobile terminal of claim 2, wherein the third matching circuit includes an inductor.

7. The mobile terminal of claim 1, further comprising:

a housing, wherein the antenna device is formed in a top portion of the housing.

8. The mobile terminal of claim 7, wherein the first non-feeding element is provided on a back face of the housing opposed to the antenna element as a conductive pattern.

9. The mobile terminal of claim 1, wherein the attitude-detection unit is configured to detect whether the mobile terminal is in a vertical or horizontal state.

10. The mobile terminal of claim 9, wherein, when the attitude-detection unit detects that the mobile terminal is in the vertical state, the first switch is configured to connect the first matching circuit to the radio-frequency unit.

11. The mobile terminal of claim 9, wherein, when the attitude-detection unit detects that the mobile terminal is in the vertical state, the second switch is configured to not ground the first non-feeding element.

12. The mobile terminal of claim 9, wherein, when the attitude-detection unit detects that the mobile terminal is in the horizontal state, the first switch is configured to connect the second matching circuit to the radio-frequency unit.

13. The mobile terminal of claim 9, wherein, when the attitude-detection unit detects that the mobile terminal is in the horizontal state, the second switch is configured to ground the first non-feeding element.

14. The mobile terminal of claim 1, wherein the antenna device further includes a second non-feeding element.

15. The mobile terminal of claim 14, further comprising:

a third switch configured to selectively ground the second non-feeding element.

16. The mobile terminal of claim 15, wherein the attitude-detection unit is configured to detect whether the mobile terminal is in a vertical state, a first horizontal state or a second horizontal state.

17. The mobile terminal of claim 16, wherein when the attitude-detection unit detects that the mobile terminal is in the vertical state, the first switch is configured to connect the first matching circuit to the radio-frequency unit, the second switch is configured to not ground the first non-feeding element, and the third switch is configured to not ground the first non-feeding element.

18. The mobile terminal of claim 16, wherein when the attitude-detection unit detects that the mobile terminal is in the first horizontal state, the first switch is configured to connect the second matching circuit to the radio-frequency unit, the second switch is configured to ground the first non-feeding element, and the third switch is configured to not ground the first non-feeding element.

19. The mobile terminal of claim 16, wherein when the attitude-detection unit detects that the mobile terminal is in the second horizontal state, the first switch is configured to connect the second matching circuit to the radio-frequency unit, the second switch is configured to not ground the first non-feeding element, and the third switch is configured to ground the first non-feeding element.

20. A mobile terminal comprising:

an antenna device including an antenna element and a non-feeding element;

means for receiving a signal from the antenna element;

first means for matching connected to the antenna element;

second means for matching connected to the antenna element;

means for selectively connecting one of the first and second means for matching to the means for receiving;

means for selectively grounding the non-feeding element;

means for detecting an attitude of the mobile terminal; and means for controlling the means for selectively connecting and means for selectively grounding based on an output of the means for detecting.

* * * * *